US009272397B2

(12) United States Patent
Goetz et al.

(10) Patent No.: US 9,272,397 B2
(45) Date of Patent: Mar. 1, 2016

(54) TRANSPORTABLE SCREWING TOOL WITH INTEGRATED SWITCHING ELEMENT

(75) Inventors: Kurt Goetz, Vaihingen (DE); Achim Kugler, Gschwend (DE)

(73) Assignee: Robert Bosch GmbH, Stuttgart (DE)

( * ) Notice: Subject to any disclaimer, the term of this patent is extended or adjusted under 35 U.S.C. 154(b) by 781 days.

(21) Appl. No.: 13/563,852

(22) Filed: Aug. 1, 2012

(65) Prior Publication Data

US 2013/0192858 A1 Aug. 1, 2013

(30) Foreign Application Priority Data

Aug. 2, 2011 (DE) ..... 10 2011 109 133

(51) Int. Cl.

| | |
|---|---|
| ***B25B 21/00*** | (2006.01) |
| ***B25B 23/142*** | (2006.01) |
| ***B25B 23/14*** | (2006.01) |
| ***B25F 5/00*** | (2006.01) |

(52) U.S. Cl.

CPC ..... *B25B 21/00* (2013.01); *B25B 23/14* (2013.01); *B25B 23/1422* (2013.01); *B25B 23/1425* (2013.01); *B25F 5/00* (2013.01)

(58) Field of Classification Search

CPC ..... G01L 3/108; G01L 5/24; B25B 23/14; B25B 23/1425; B25B 23/142; B25B 23/1422; B25B 21/00; B25B 13/462

USPC ..... 173/1, 2, 176, 181, 182, 183, 217, 216; 81/429, 467, 479, 469; 73/862.23, 73/862.35, 761

See application file for complete search history.

(56) References Cited

U.S. PATENT DOCUMENTS

| | | | | | |
|---|---|---|---|---|---|
| 3,970,155 | A * | 7/1976 | Otto | 73/862.26 |
| 4,805,404 | A * | 2/1989 | Dupin | 60/409 |
| 4,987,806 | A * | 1/1991 | Lehnert | 81/469 |
| 5,172,616 | A * | 12/1992 | Negishi | 81/467 |
| 5,315,501 | A * | 5/1994 | Whitehouse | 700/32 |
| 5,476,014 | A * | 12/1995 | Lampe et al. | 73/862.23 |
| 5,637,968 | A * | 6/1997 | Kainec et al. | 318/432 |
| 5,701,961 | A * | 12/1997 | Warner et al. | 173/15 |
| 6,070,506 | A * | 6/2000 | Becker | 81/479 |
| 6,119,562 | A * | 9/2000 | Jenkins | 81/479 |
| 6,523,442 | B2 * | 2/2003 | Lehnert et al. | 81/467 |
| 6,923,268 | B2 * | 8/2005 | Totsu | 173/2 |
| 6,968,759 | B2 * | 11/2005 | Becker et al. | 81/479 |
| 6,983,809 | B2 * | 1/2006 | Leitenberger et al. | 173/176 |
| 7,089,834 | B2 * | 8/2006 | Reynertson et al. | 81/479 |
| 7,107,884 | B2 * | 9/2006 | Cutler et al. | 81/479 |
| 7,313,990 | B1 * | 1/2008 | Shiao | 81/479 |
| 7,410,006 | B2 * | 8/2008 | Zhang et al. | 173/1 |
| 7,415,897 | B2 * | 8/2008 | Shiao | 73/862.21 |
| 7,828,077 | B1 * | 11/2010 | Miller et al. | 173/217 |

(Continued)

*Primary Examiner* — Scott A. Smith

(74) *Attorney, Agent, or Firm* — Maginot, Moore & Beck LLP

(57) ABSTRACT

A transportable screwing tool configured to mount and/or dismount screws into and/or out of a work piece includes an electric motor operable by electrical energy and a switching element configured to activate and/or deactivate the electric motor. The screwing tool further includes a drive train arranged inside a housing of the screwing tool. The drive train is mounted pivotably about an axis of rotation arranged essentially perpendicularly to the drive train. A method for activating and/or deactivating the electric motor includes moving at least one element of the switching element for the purpose of activating the electric motor out of a position of nonuse into a position of use when the drive train is moved in rotation about the axis of rotation.

11 Claims, 1 Drawing Sheet

(56) References Cited

U.S. PATENT DOCUMENTS 7,841,100 B2 * 11/2010 Lucke ..... 33/534
7,878,076 B2 * 2/2011 Lucke et al. ..... 73/862.23
8,171,828 B2 * 5/2012 Duvan et al. ..... 81/479
8,172,607 B2 * 5/2012 Chiapuzzi ..... 439/577
8,286,723 B2 * 10/2012 Puzio et al. ..... 173/1
8,316,741 B2 * 11/2012 Wallgren ..... 81/469

* cited by examiner

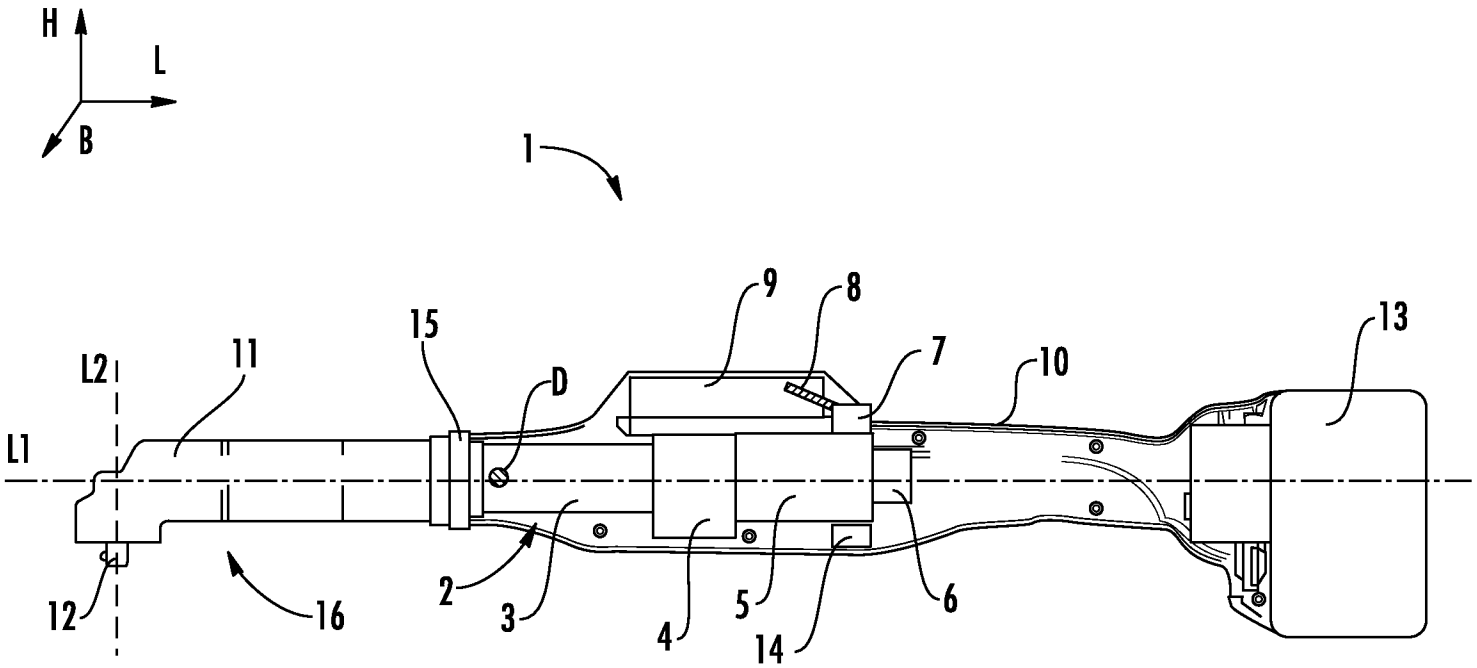
13
10
7
6
8
14
9
5
4
1
D
3
2
15
16
11
L
H
B
L2
12
L1

TRANSPORTABLE SCREWING TOOL WITH INTEGRATED SWITCHING ELEMENT

This application claims priority under 35 U.S.C. §119 to patent application no. DE 10 2011 109 133.9, filed on Aug. 2, 2011 in Germany, the disclosure of which is incorporated herein by reference in its entirety.

BACKGROUND

The present disclosure relates to a transportable screwing tool for mounting and/or demounting screws into and/or out of a work piece and to a method for activating and/or deactivating an electric motor, operable by electrical energy, of the screwing tool by means of the switching element.

However, the present disclosure can also be applied to other tools, such as, for example, grinding tools, polishing tools, drilling tools or the like.

Hand-operated screw drivers or portable hand-operated screwing appliances or tools which are known from the general prior art mostly have a starting switch arranged on the outside of the housing of the screwing tool. This starting switch is in this case arranged either directly in the grip region of the screwing tool, by which the screwing tool is held by the user, or on a further additional handle of the screwing tool, which is used, for example, in order to apply increased pressure force to the screwing tool during its use, or is integrated in these grips.

That is to say, when the screwing tool is being handled, the starting switch has to be actuated actively by the user. When the screwing tool is being used essentially continuously or frequently, as, for example, in an assembly line of a product-producing enterprise, the screwing tool consequently has to be started, before each work step, by the starting switch being actuated and has to be switched off, after each work step, by the starting switch being actuated once again, for example in order to avoid injury to the user caused by the screwing tool between the individual work steps. Such frequent actuation of the starting switch of the screwing tool may quickly lead to fatigue of the user's hand and, in particular, of the user's finger joint regions, and because of this it is no longer ensured that the screwing tool is held and guided safely.

Furthermore, constant actuation of the starting switch of the screwing tool causes the production cycle time to be prolonged, since activation and deactivation of the starting switch of the screwing tool by the user requires time or a period of time in which no screws can be screwed into or out of a work piece.

Arranging a starting switch in the region of the handles of the screwing tool, with the result that it should become easier to activate or deactivate the starting switch since there is no need to change over the hand from activating the screwing tool or the motor of the screwing tool to guiding the screwing tool, also results in an unfavorable ergonomic posture of the user's hand when the screwing tool is being operated, since the user or operator always has to be careful not to touch the starting switch during the screwing operation, in order to avoid an unintentional switch-off of the screwing tool.

The object of the present disclosure is, therefore, to make available a transportable screwing tool for mounting and/or demounting screws and a method for activating or deactivating the screwing tool, which allow rapid, ergonomic and simple starting of a screwing tool and consequently rapid and simple and also ergonomic and low-fatigue operation of the screwing tool.

SUMMARY

The present disclosure achieves this object by means of a transportable screwing tool and a method for activating and/or deactivating the screwing tool.

Advantageous embodiments and developments are the subject matter of the sub claims.

Accordingly, on the one hand, a transportable screwing tool for mounting and/or demounting screws into and/or out of a work piece, with an electric motor operable by electrical energy and with a switching element for activating and/or deactivating the electric motor, is claimed.

A drive train, which is mounted pivotably about an axis of rotation arranged essentially perpendicularly to the drive train, is arranged inside a housing of the screwing tool according to the disclosure, in order, when the drive train is moved in rotation about the axis of rotation, to move at least one element of the switching element for the purpose of activating the electric motor out of a position of nonuse into a position of use.

The axis of rotation consequently extends preferably in the width direction of the drive train or of the screwing tool and therefore perpendicularly with respect to the essentially centrally oriented longitudinal axis of the drive train.

The transportable screwing tool is a hand-operated screwing appliance and, in particular, a transportable offset screw driver or offset screwing tool, which preferably has at least one energy accumulator unit for the storage of electrical energy, so that the screwing tool can be used freely without tie-up to a cable, that is to say so as to be unimpeded in the range of movement, inside or outside a building for the purpose of screwing screws into or out of a work piece.

To charge the energy accumulator unit, the screwing tool is placed, for example, onto a charging station. It is also possible to exchange the energy accumulator unit of the screwing tool, so that, when an energy accumulator unit is emptied, an energy accumulator unit preferably charged completely with electrical energy can be inserted into the screwing tool.

Moreover, it is also conceivable, alternatively or additionally to the energy accumulator unit, to connect the screwing tool, for example during use, to an external power supply source, such as a local power network, via a cable conducting electrical energy, although, because of this, the radius of movement for using the screwing tool is dependent upon the length of the cable.

The drive train of the screwing tool is preferably arranged on a screwing spindle which, in turn, is connected to a screwing head or to a drill chuck arranged at an angle of 90° to the screwing spindle, so that the screwing spindle can be rotated about its longitudinal axis, with the result that the drill chuck is also correspondingly set in rotation about its mid-axis or longitudinal axis.

The essentially centrally arranged longitudinal axis of the screwing spindle corresponds essentially to the longitudinal axis of the drive train, which longitudinal axis extends essentially perpendicularly with respect to the axis of rotation in the longitudinal direction of the screwing tool.

The screwing spindle and the drive train and, in particular, the central longitudinal axis of the screwing spindle and the central longitudinal axis of the drive train consequently form a common central longitudinal axis lying on one plane and essentially prolonging one another.

The screw spindle is preferably arranged centrally in an angled head which surrounds the screwing spindle preferably completely in the circumferential direction. The central longitudinal axis of the screwing spindle therefore corresponds essentially to the central longitudinal axis of the angled head, so that the central longitudinal axis of the angled head forms the prolongation of the central longitudinal axis of the drive train.

In a preferred embodiment, alternatively and, in particular, additionally, the angled head is connected rigidly to the drive train or is arranged, free of movement, on the drive train.

That is to say, during movement of the screwing spindle or of the entire angled head, including the screwing spindle, with respect to the housing of the screwing tool, the drive train is likewise moved with respect to the housing of the screwing tool.

Particularly during a pivoting movement of the screwing spindle or of the angled head about a center of rotation or about the axis of rotation, the drive train is also pivoted about this center of rotation or about this axis of rotation.

For driving a screwing spindle, the electric motor is connected preferably to a gear and, in particular, to an epicyclic gear, for example in order, depending on the desired setting by the user, to enable the screwing spindle and consequently the screwing head connected to the screwing spindle to rotate to the right or rotate to the left.

Consequently, the drive train arranged inside the housing of the screwing tool preferably has at least the electric motor and a gear connected rigidly to the latter.

Preferably, the screwing spindle is also a portion or region of the drive train and preferably also one or more bearing devices for the rotatable mounting of the screwing spindle.

Rigidly connected is understood in this context to mean that the electric motor is fixed to the gear or the gear is fixed to the electric motor in such a way that, during movement of the electric motor with respect to the housing in a defined direction, the gear is also moved with respect to the housing in this defined direction.

Furthermore, it is conceivable that, in addition to the electric motor and the gear, the drive train also has a measuring element arranged essentially rigidly on the gear.

The measuring element itself serves preferably for measuring the rotational speed and/or for determining the torque, so that, depending on the desired setting by the user, a screwing operation can be carried out at a correspondingly high or corresponding low rotational speed. The rotational speed itself is preferably set via the gear and/or the electric motor. That is to say, the values measured by the measuring element are preferably transferred to control electronics which carry out matching between the currently measured rotational speed values and the rotational speed values set and therefore desired by the user. If the control electronics ascertain that the currently present rotational speed does not correspond to the rotational speed set and therefore desired by the user, the gear and/or the electric motor are/is activated correspondingly by the control electronics, in order, by a variation of the most diverse parameters, to achieve the rotational speed desired by the user.

Moreover, it is conceivable that the drive train also has a rotary encoder which is preferably arranged on a region of the electric motor. The rotary encoder, which, in particular, can determine the distance and/or the direction of travel or the angle change and/or the direction of rotation, ensures that, after a defined distance or a defined angle of rotation is reached, a corresponding signal is transmitted to the control electronics, with the result that deactivation of the electric motor by the control electronics can be brought about.

This is necessary, inter alia, during the mounting of screws which, for example, are to be screwed with only a defined torque, in order to avoid damage to the screws during the mounting process. The result of damage, that is to say cracked or broken screws is that the screw connection regions of the work piece can no longer be connected to one another, as required, with the result that damage to the work piece and to the product having the work piece may occur when the inadequately screwed-together work piece is used.

In a preferred embodiment, a connection element is arranged between the switching element, which is used for activating and/or deactivating the electric motor, and control electronics arranged essentially immovably with respect to the housing.

The connection element, which may be either a mechanical element or an electrical or electronic line or the like, is preferably connected to the switching element and the control electronics in such a way that movements of the switching element with respect to the housing can be detected or transmitted by the connection element and can be recognized by the control electronics.

Movement of the switching element with respect to the housing is possible especially when, in a further preferred embodiment, the switching element is essentially fixed or is arranged firmly on the drive train, in order, during a pivoting movement of the drive train about the axis of rotation, likewise to be moved with respect to the housing.

Thus, it is conceivable that, as a result of movement of the screwing spindle or of the angled head about the axis of rotation, the drive train is also pivoted about the axis of rotation and at the same time the switching element mounted on the drive shaft is pivoted essentially about this axis of rotation, so that the screwing spindle or the angled head, the drive shaft and the switching element are moved essentially simultaneously with respect to the housing of the screwing tool.

In a further preferred embodiment, a spring element is arranged on the drive train in order to hold the drive train in a position of rest and/or urge it into a position of rest when the screwing tool is not in use.

The spring element is in this case arranged in such a way that it holds the drive train in a preferred position of equilibrium either by applying a spring pressure force to the drive train or by applying a spring tension force to the latter.

In the position of equilibrium or position of rest of the drive train, the latter lies essentially centrally inside the housing of the screwing tool without a pivoting movement or rotation about the axis of rotation having taken place.

Consequently, the weight of the drive train either loads the spring element in such a way that the spring element is compressed counter to the spring force or the weight of the drive train is suspended on the spring element in such a way that the spring element is tensioned counter to the spring force.

As already stated above, the drive train is connected essentially rigidly to an angled head screwing element rotatable about the axis of rotation, that is to say to a screwing spindle and/or an angled head with a drill chuck arranged on it, in order to be deflected out of a position of rest into an activation position when the angled head screwing element is deflected about the axis of rotation.

That is to say, when a defined pressure force is applied to the angled head screwing element and, in particular, to the drill chuck of the screwing tool, for example during a screwing operation, the angled head screwing element pivots about the axis of rotation, with the result that the drive train connected to the angled head screwing element also consequently pivots about the axis of rotation counter to the spring force.

That is to say, after a pressure force higher than the spring force is applied to the angled head screwing element, a pivoting movement of the drive train about the axis of rotation and consequently preferably also movement of the switching element with respect to the housing take place.

As a result of a first movement, that is to say movement in a first direction, of the switching element with respect to the housing, the connection element, which is arranged, on the one hand, on the switching element and, on the other hand, for example, on the control electronics arranged immovably in relation to the housing, is likewise moved. Such a first movement activates the switching element in that the switching element activates or starts the electric motor, with the result that a screwing operation can be started.

That is to say, when the screwing tool, particularly the offset screw driver or offset screwing tool, is pressed with the screwing head against a screw to be screwed in or else to be unscrewed, a pivoting movement of the entire screwing spindle or of the angled head takes place about the centre of rotation or axis of rotation, and consequently also a pivoting movement of the drive train, connected rigidly to the screwing spindle or angled head, with respect to the housing about the axis of rotation counter to the spring force in a first direction. The connection element is thereby also deflected in a first direction, the switching element is switched and the electric motor is activated.

If, then, the pressure on the screwing head is reduced, for example after the screwing operation, the drive train is moved back into its position of equilibrium, that is to say its position of rest, by the spring force, in that the drive train, together with the corresponding switching element, is pivoted about the axis of rotation opposite to the first movement. The connection element is thereby also moved in a second direction which is opposite to the first direction, with the result that the switching element is switched again and, by being switched in this way, deactivates or switches off the electric motor.

Furthermore, consequently, a method for activating and/or deactivating an electric motor, operable by electrical energy, by means of a switching element, which is arranged inside a housing of a screwing tool for mounting and/or demounting screws into and/or out of a work piece, is claimed, an essentially rigidly designed drive train connected essentially rigidly to an angled head screwing element being pivoted, on account of loading of the angled head screwing element, by rotation about an axis of rotation arranged essentially perpendicularly to the drive train, at least one element of the switching element being moved out of a position of nonuse into a position of use as a result of the pivoting movement of the drive train about the axis of rotation, in order to activate the electric motor.

In a preferred embodiment, when a defined pressure force is applied to the angled head screwing element, the drive train is moved out of a position of rest into an activation position counter to a spring force generated by a spring element.

BRIEF DESCRIPTION OF THE DRAWING

Further advantages, aims and properties of the present disclosure are explained by means of the following description of an appended drawing in which an embodiment of the screwing tool according to the disclosure is illustrated by way of example.

FIG. 1 shows an embodiment of the screwing tool according to the disclosure.

DETAILED DESCRIPTION

FIG. 1 shows an embodiment of the screwing tool 1 according to the disclosure which is designed as an angled head screwing tool 1. The screwing tool 1 has a drive train 2 with a measuring element 3, with a gear 4, with a motor 5 and with a rotary encoder 6.

Fixed to the drive train 2 extending essentially in a longitudinal direction L is a switching element 7, on which a connection element 8 likewise connected to control electronics 9 is arranged.

The drive train 2 is mounted resiliently via a spring element 14, spring force supplied to the drive train 2 by the spring element 14 holding the drive train in a position of rest during a nonuse configuration of the screwing tool 1.

The drive train and also the screwing spindle (not shown here) located in the angled head 11 are connected essentially rigidly or stiffly to one another and are arranged pivotably about an axis of rotation D which extends essentially perpendicularly with respect to the essentially centrally arranged longitudinal axis L1 of the drive train 2 or screwing tool 1 in the width direction B of the screwing tool 1.

Arranged on the screwing spindle is a screwing head 12 or a drill chuck 12 which is moved in rotation about its central longitudinal axis L2 via the screwing spindle.

The drive train 2, switching element 7, connection element 8, control electronics 9, spring element 14 and screwing spindle are preferably arranged inside a housing 10 of the screwing tool, in order to protect these against contamination and damage from outside.

That is to say, in particular, the switching element 7 is surrounded completely by the housing 10 of the screwing tool 1, and therefore direct contact with the switching element 7 by the user of the screwing tool 1 can be ruled out.

The housing 10 of the screwing tool 1 is preferably designed to be closed essentially in the circumferential direction around, for example, the drive train 2, switching element 7, connection element 8 and control electronics 9.

Furthermore, the screwing tool 1 has an energy accumulator unit 13 or accumulator 13 for the storage of electrical energy so that the electric motor 5 can be fed with electrical energy while the screwing tool 1 is being used. The energy accumulator unit 13 may be arranged either in the housing 10 of the screwing tool 1 or outside the housing 10 of the screwing tool 1.

When the screwing head 12 is placed onto a screw (not shown here) or a screwing element (not shown here), the electric motor 5 of the screwing tool 1 is preferably not yet activated, as long as the pressure force applied to the screwing head 12 is no greater than the spring force.

When the pressure force on the screwing head 12 is increased, for example in that the user of the screwing tool 1 presses with the screwing tool 1 and, in particular, the screwing head 12 against the screw to be screwed in or out, so that the force applied to the screwing head 12 essentially exceeds the spring force of the spring element 14, the screwing head 12 is moved essentially slightly in the direction of the screwing tool 1, that is to say in the height direction H of the screwing tool 1 (with respect to the housing 10). As a result of this movement, for example, the screwing spindle mounted in the angled head 11 or the entire angled head 11 is pivoted preferably clockwise about the axis of rotation D through a defined angle, with the result that the drive train 2 which is essentially fixed to the screwing spindle is also at the same time pivoted about the axis of rotation D.

On the drive train 2 pivoting essentially clockwise about the axis of rotation D, pressure force which is higher than the spring force of the spring element 14 is applied to the spring element 14 by the drive train 2, with the result that, according to the embodiment of FIG. 1, the spring element 14 is compressed.

The switching element 7, preferably connected firmly to the drive train, is then moved with respect to the housing 10 together with the drive train 2, which is moved out of its position of rest into an activation position, with the screw spindle or angled head 11 and with the screwing head 12. In this case, the drive train 2 and the switching element 7 are arranged inside the housing 11 and the screwing spindle is arranged within the angled head 11.

As a result of such movement of the switching element 7 essentially in the height direction H of the screwing tool 1 downward, that is to say in a first movement direction, the connection element 8 connected to the switching element 7 is likewise moved out of a position of nonuse into a position of use.

As a result of the change in position of the connection element 8, an element of the switching element 7 is switched in such a way that the switching element 8 enables the electric motor 5 to be activated.

That is to say, by the changing in position of the connection element 8, the switching element 7 is switched in such a way that, for example, it allows an electrical current flux from the energy accumulator unit 13 to the electric motor 5, in that a switch of the switching element 7 has been closed due to the change in position of the connection element 8.

If, then, the screwing operation is terminated or, for example, is interrupted and the user reduces the pressure force applied to the screwing head 12 to below the spring force of the spring element 14, the drive train 2 is moved by the spring force of the spring element 14 out of the activation position into its position of rest again and is consequently pivoted counterclockwise about the axis of rotation D.

The screwing spindle or angled head 11 is therefore also pivoted counterclockwise about the axis of rotation D.

The switching element 7 is moved from the position of use into the initial position of nonuse again in exactly the same way as the connection element 8, so that such a second movement, or movement in a second direction opposite to the first direction, of the connection element 8 causes, for example, opening of a switch of the switching element 7, with the result that a flux of electrical current, in particular, from the energy accumulator unit 13 to the electric motor 5 is interrupted. Consequently, the operation of the electric motor 5 is also interrupted and the electric motor 5 is therefore deactivated or switched off. The screwing spindle and the screwing head 12 are consequently no longer rotated. The screwing operation has accordingly been interrupted.

As already stated above, it is consequently conceivable that not only does the screw spindle arranged inside the angled head 11 execute a pivoting movement about the axis of rotation D, but the entire angled head is also essentially pivoted about the axis of rotation D.

In this embodiment, it is necessary that a sealing element 15, such as, for example, a sealing ring, etc., is arranged between the angled head 11 and a region of the housing 10 to which the angled head 11 is adjacent, in order to seal off the transitional region between the angled head 11 and the housing 10 against the penetration of moisture and dirt, etc.

The angled head 11 and/or the screwing spindles together with the corresponding screwing head 12 together form the angled head screwing element 16 which is pivoted about the axis of rotation D clockwise when pressure force is applied and counterclockwise when the pressure force is removed.

The control electronics 9 are preferably connected immovably with respect to the housing 10, in particular to the housing 10, and record movement of the connection element 8 out of a position of nonuse into a position of use and also out of the position of use into the position of nonuse.

If, for example, the control electronics 9 record the movement of the connection element 8 in a first direction, that is to say out of the position of nonuse into a position of use, the control electronics 9 activate, for example, the measuring element 3 and/or the rotary encoder 6, so that the rotational speed and/or torque of the motor or screw spindle can be set or monitored.

The gear 4, which is preferably designed as an epicyclic gear 4, is also set or monitored by the control electronics 9.

That is to say, the control electronics 9 are activated, in particular, by movement of the connection element 8 in a first direction, so that the specific control and regulation of the screwing tool 1 can be carried out.

The control electronics 9 therefore deactivate the measuring element 3 and/or the rotary encoder 6 when the connection element 8 is moved in a second direction, which is opposite to the first direction, that is to say out of a position of use into a position of nonuse. In particular, the control electronics themselves are deactivated as a result of this movement.

The control electronics 9 receive scheduled information or scheduled data relating to torque or rotational speed and the like with regard to a defined work step preferably from a central control device (not shown here) via a radio connection, such as, for example, Bluetooth or W-LAN.

That is to say, the data or information stored in the central control device and relating to the individual work steps are transmitted to the control electronics 9 of the screwing tool 1 just in time before the execution of the work step by the screwing tool, so that the control electronics can carry out the settings for adhering to the scheduled information or scheduled data essentially directly before the work step or work cycle is executed.

The central control device itself receives the corresponding information or data relating to the individual work steps of the screwing tool 1, for example, by the appropriate programmer or programming engineer who stores all the required data preferably on a memory device of the control device, so that the control device can access all the required data and information, as required, at any time.

It is also conceivable, however, that the screwing tool has a dedicated memory device (not shown here) on which all the required data and information for each work cycle or work step which is to be or can be executed or executable are stored, so that the screwing tool 1 receives all the required information or data relating to the individual steps of the work cycle from the central control device only before the commencement of an order composed of a multiplicity of work steps, stores this information or data in the dedicated memory device and accesses them, as required, by means of the control electronics.

The applicant reserves the right to claim all the features disclosed in the application documents as being essential to the disclosure, insofar as they are novel individually or in combination with respect to the prior art.

What is claimed is:

1. A transportable screwing tool for mounting and/or demounting screws into and/or out of a work piece, comprising:

a housing defining a first longitudinal axis;

an electric motor;

a switching element having a first position and a second position and configured for one or more of activating and deactivating the electric motor when moved between the first position and the second position; and a drive train supported by the housing and pivotable about an axis of rotation with respect to the housing, the drive train operably connected to the electric motor and including a screwing spindle defining a second longitudinal axis, wherein:

the axis of rotation is perpendicular to a plane defined by the first longitudinal axis and second longitudinal axis; and the drive train is operably connected to the switching element such that as the drive train pivots about the axis of rotation in a first direction, the switching element is moved from the first position to the second position.

2. The screwing tool according to claim 1, wherein the drive train includes a gear connected rigidly to the electric motor.

3. The screwing tool according to claim 2, wherein the drive train has a measuring element arranged rigidly on the gear.

4. The screwing tool according to claim 2, wherein the drive train has a rotary encoder.

5. The screwing tool according to claim 1, further comprising:

control electronics arranged rigidly with respect to the housing; and a connection element arranged between the switching element and the control electronics.

6. The screwing tool according to claim 1, wherein the switching element is fixed to the drive train such that the switching element moves with the drive train with respect to the housing as the drive train pivots about the axis of rotation.

7. The screwing tool according to claim 1, further comprising a spring element arranged on the drive train to urge the drive train in a second direction opposite to the first direction into a position of rest when the screwing tool is not in use.

8. The screwing tool according to claim 1, further comprising an angled head screwing element that is rigidly connected to the drive train such that deflection of the angled head screwing element pivots the drive train about the axis of rotation in the first direction out of a position of rest and toward an activation position.

9. The screwing tool according to claim 1, wherein the screwing tool has at least one energy accumulator unit configured to store electrical energy.

10. A method for activating and/or deactivating an electric motor by use of a switching element which is arranged inside a housing of a screwing tool configured to mount and/or dismount screws into and/or out of a work piece, comprising:

applying a pressure force on an angled head screwing element of the screwing tool, wherein:

the housing defines a first longitudinal axis;

the angled head screwing element defines a second longitudinal axis, and is rigidly connected to a drive train of the screwing tool;

the drive train is supported by the housing, is pivotable with respect to the housing about an axis of rotation perpendicular to a plane defined by the first longitudinal axis and second longitudinal axis, and is operatively connected to the electric motor and the switching element;

pivoting the drive train in a first direction about the axis of rotation via the pressure force acting on the angled head screwing element to move the switching element from a first position to a second position, the switching element configured to activate the electric motor when moved from the first position to the second position; and activating the electric motor of the switching tool by moving the switching element from the first position to the second position in order to operate the angled head screwing element.

11. The method according to claim 10, wherein:

the screwing tool further includes a spring element that is arranged in the housing and that is configured to exert a spring force on the drive train in a second direction opposite to the first direction and toward a position of rest; and the drive train is moved out of the position of rest into an activation position to move the switching element from the first position to the second position when the pressure force applied to the angled head screwing element is sufficient to overcome the spring force of the spring element.

* * * * *